US009754716B2

(12) United States Patent
Mumford

(10) Patent No.: US 9,754,716 B2
(45) Date of Patent: Sep. 5, 2017

(54) CURRENT LIMITER

(75) Inventor: Francis Mumford, Weston (GB)

(73) Assignee: GENERAL ELECTRIC TECHNOLOGY GMBH (CH)

( * ) Notice: Subject to any disclaimer, the term of this patent is extended or adjusted under 35 U.S.C. 154(b) by 19 days.

(21) Appl. No.: 14/236,623

(22) PCT Filed: Aug. 1, 2011

(86) PCT No.: PCT/EP2011/063189

§ 371 (c)(1),
(2), (4) Date: Feb. 1, 2014

(87) PCT Pub. No.: WO2013/017159

PCT Pub. Date: Feb. 7, 2013

(65) Prior Publication Data

US 2014/0184373 A1 Jul. 3, 2014

(51) Int. Cl.

| | |
|---|---|
| ***H01F 27/28*** | (2006.01) |
| ***H01F 21/06*** | (2006.01) |
| ***H01F 37/00*** | (2006.01) |
| ***H01F 6/00*** | (2006.01) |
| ***H01F 6/06*** | (2006.01) |

(52) U.S. Cl.

CPC ..... *H01F 37/00* (2013.01); *H01F 6/00* (2013.01); *H01F 6/06* (2013.01); *H01F 2006/001* (2013.01)

(58) Field of Classification Search

CPC ..... H01F 38/30; H01F 27/365; H01F 27/38; H01F 17/04; H01F 27/427; H01F 6/06; H01F 37/00; H01F 2006/001

USPC ..... 336/73, 136, 170

See application file for complete search history.

(56) References Cited

U.S. PATENT DOCUMENTS

| | | | | |
|---|---|---|---|---|
| 3,283,277 | A * | 11/1966 | Hulm et al. | 335/216 |
| 3,579,165 | A * | 5/1971 | Johnson | 336/170 |
| 4,680,666 | A * | 7/1987 | Rios | G01R 33/3815 335/301 |
| 5,153,804 | A * | 10/1992 | Pham | H01H 33/004 324/248 |
| 5,307,044 | A * | 4/1994 | Watabe | H01F 27/25 29/605 |
| 5,694,279 | A * | 12/1997 | Mumford | 361/19 |
| 5,892,644 | A | 4/1999 | Evans et al. | |
| 6,154,113 | A * | 11/2000 | Murai | H01F 27/2828 336/192 |
| 6,373,014 | B1 * | 4/2002 | Mitsuhashi | H01H 33/98 218/22 |
| 7,274,281 | B2 * | 9/2007 | Sugioka | 336/170 |
| 2003/0107862 | A1 * | 6/2003 | Cha | 361/93.1 |
| 2004/0120083 | A1 * | 6/2004 | Cha et al. | 361/19 |

(Continued)

OTHER PUBLICATIONS

International Search Report and Written Opinion in International Application No. PCT/EP2011/063189, mailed Apr. 3, 2012.

*Primary Examiner* — Tsz Chan
*Assistant Examiner* — Kazi Hossain
(74) *Attorney, Agent, or Firm* — GE Global Patent Operation; Scott R. Stanley

(57) ABSTRACT

A current limiter comprises a plurality of electrically conductive wires shaped to define two or more primary coils, the primary coils being connected in parallel; and at least one electrically superconductive element shaped to define a secondary coil, wherein the primary coils are magnetically coupled to the or each secondary coil.

11 Claims, 2 Drawing Sheets

(56) References Cited

U.S. PATENT DOCUMENTS

Figure 1:
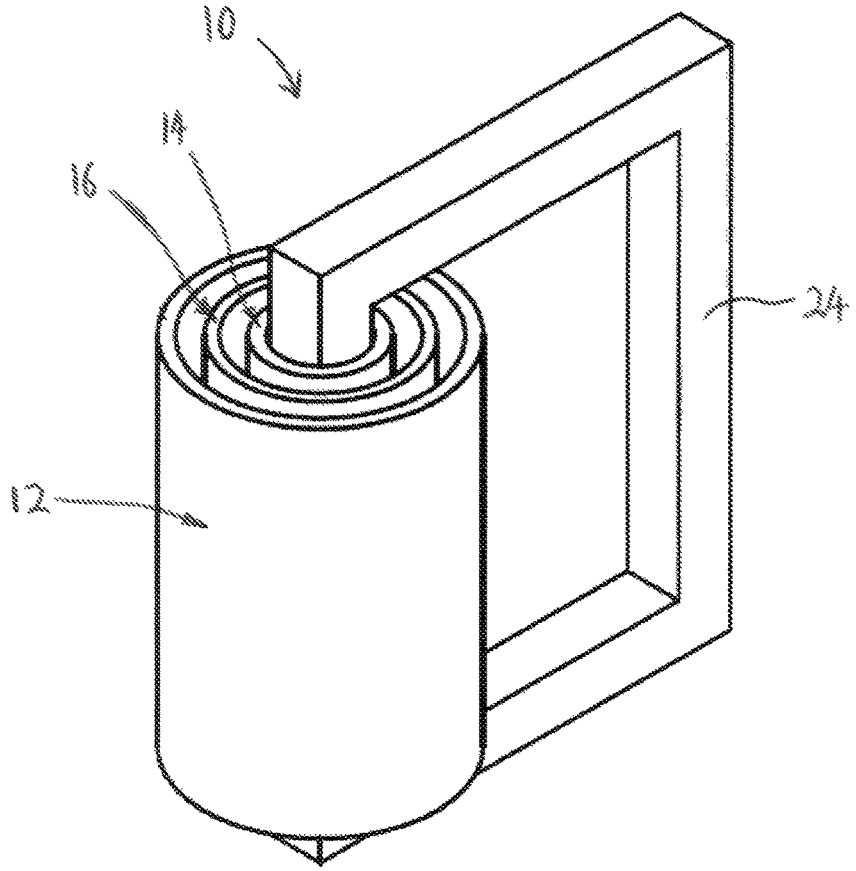

| | | | | |
|---|---|---|---|---|
| 2004/0251999 | A1* | 12/2004 | Darmann | 336/180 |
| 2007/0216508 | A1* | 9/2007 | Ger | H05B 41/2822 336/198 |
| 2007/0257755 | A1 | 11/2007 | Choi et al. | |
| 2009/0243776 | A1* | 10/2009 | Park | H01F 30/04 336/184 |
| 2010/0060399 | A1* | 3/2010 | Lai | H01F 3/12 336/170 |
| 2011/0316662 | A1* | 12/2011 | Pregartner et al. | 336/221 |
| 2012/0007706 | A1* | 1/2012 | Wetteland | 336/60 |
| 2012/0264613 | A1* | 10/2012 | Tekletsadik | H02H 9/023 505/150 |
| 2012/0326825 | A1* | 12/2012 | San Martin et al. | 336/170 |

* cited by examiner

CURRENT LIMITER

CROSS REFERENCE TO RELATED APPLICATIONS

This application is the national stage of International Application No. PCT/EP2011/063189, filed Aug. 1, 2011, entitled, "Current Limiter," the contents of which are incorporated herein by reference in their entirety.

This invention relates to a current limiter.

When operating any electrical apparatus, the electrical current flowing through the apparatus is typically maintained within a predetermined current rating of the electrical apparatus. However, fault or other abnormal operating conditions in the electrical apparatus may lead to the development of a high fault current exceeding the current rating of the electrical apparatus.

The development of high fault current may not only result in damage to the electrical apparatus components, but also result in the electrical apparatus being offline for a period of time. This results in increased cost of repair and maintenance of damaged electrical apparatus hardware, and inconvenience to end users relying on the working of the electrical apparatus.

The aforementioned adverse effects may be prevented by limiting the magnitude of the high fault current using a current limiter such as a shielded inductive superconducting fault current limiter.

According to an aspect of the invention, there is provided a current limiter comprising a plurality of electrically conductive wires shaped to define two or more primary coils, the primary coils being connected in parallel; and at least one electrically superconductive element shaped to define a secondary coil, wherein the plurality of primary coils are magnetically coupled to the or each secondary coil.

The provision of two or more parallel-connected primary coils in the current limiter encapsulating the secondary winding, when compared to arrangements in which a single primary coil is magnetically coupled with an electrically superconductive secondary coil, results in a reduction in magnitude of leakage flux between the plurality of primary coils and the secondary coil.

This in turn reduces the effective leakage reactance of the primary coils that is presented to an external electrical circuit connected to the primary coils. Consequently a lower percentage of the electrical circuit supply voltage appears across the parallel-connected primary coils, which decreases the amount of voltage lost to the leakage reactance and thereby improves the efficiency of the external electrical circuit.

Another approach for reducing leakage flux in a current limiter would be to minimise the amount of annular space between the primary and secondary coils so as to improve their mutual magnetic coupling. However, since the superconductive coil are typically stored in a cryostat housing that stores coolant, such an approach would require reduction of the radial dimensions of the cryostat housing. This in turn reduces the volume available for storing the coolant, and thereby increases the risk of inadequate cooling of the superconductive coil during operation of the current limiter. In comparison, the use of parallel-connected primary coils to reduce leakage flux does not require modification of a cryostat housing used to contain the superconductive secondary coil.

In addition, the reduction in leakage flux between the primary and secondary coils reduces the magnetic forces acting on the superconducting secondary coil, which minimises the risk of the superconducting secondary coil accidentally entering a quench state.

The reduction in current flowing through each primary coil is also advantageous in that it improves surface cooling efficiency of the current limiter, since the amount of heat generated by each primary coil is proportional to the square value of the current flowing through the respective primary coil.

The structure of the current limiter may vary depending on the requirements of the current limiter. In embodiments of the invention, at least one primary coil may be wound around the secondary coil, and the secondary coil may be wound around at least one other primary coil.

Preferably the current limiter further includes at least one coil former, the or each former supporting at least one primary coil to help retain the required shape of each primary coil. In further embodiments, the coils may be wound around a portion of a magnetic-core element or an air-core element. In such embodiments, the cross-section of the magnetic core element may be circular, oval or polyhedral in shape. The inclusion of a magnetic core element increases the strength of the magnetic field by concentrating the generated magnetic field lines.

Preferably each coil may be in the form of a solenoid so as to provide a near uniform and controlled magnetic field.

The or each secondary coil is preferably a tubular element, which may be provided in the form of a ring, to define a one-turn coil. In such embodiments the current limiter may include a plurality of secondary coils in the form of tubular elements, the secondary coils being arranged to define a plurality of parallel-connected concentric tubes, i.e. a plurality of one-turn parallel-connected coils.

In embodiments of the invention, the current limiter may further include a cryostat housing defining an enclosure around the secondary coil.

The purpose of the cryostat housing is to store coolant, such as liquid nitrogen, to cool the superconducting secondary coil, particularly after the secondary coil enters a quench state, which occurs during and after a short-circuit of the secondary coil in a fault current limiting scenario.

In other embodiments, the plurality of primary coils may be operably connected, in use, to one or more electrical circuits. In such embodiments, each primary coil may present an impedance to minimise a fault current created by a fault, in use, in an electrical circuit.

The current limiter may be used to minimise fault current in one or more associated electrical circuits during fault conditions or other abnormal operating conditions so as to prevent damage to the or each associated electrical circuit.

Figure 2:
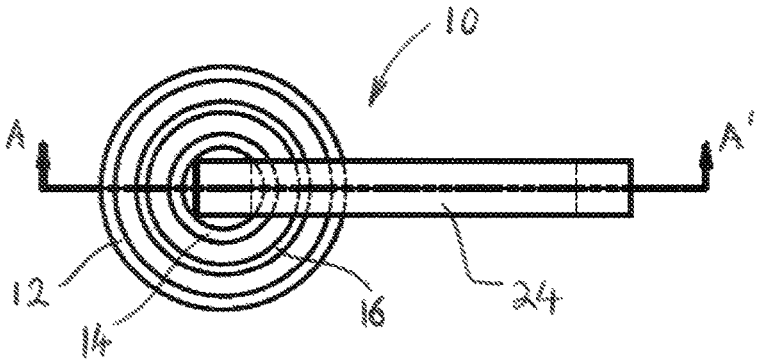
Figure 3:
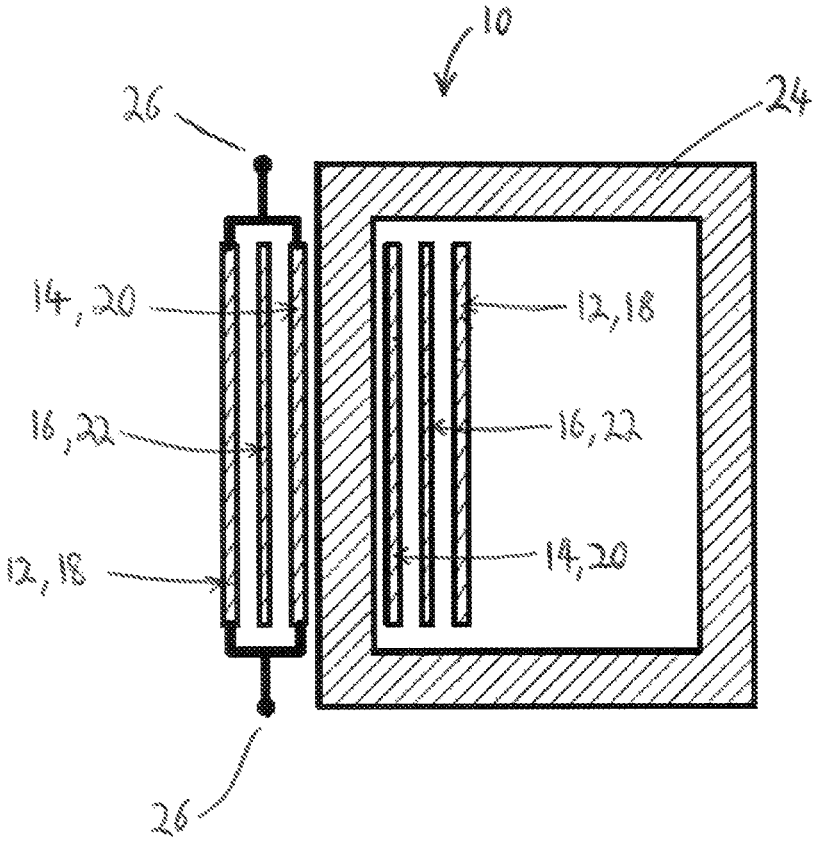

Preferred embodiments of the invention will now be described, by way of non-limiting examples:

FIGS. 1 and 2 show a current limiter according to an embodiment of the invention; and FIG. 3 shows a cross-section of the current limiter along line A-A' of FIG. 2.

A current limiter 10 according to an embodiment of the invention is shown in FIGS. 1 and 2.

The current limiter 10 comprises first and second electrically conductive wires 12,14 and an electrically superconductive element 16.

The current limiter 10 further includes first and second cylindrical formers and a cylindrical cryostat housing (not shown). Each of the formers and the cryostat housing has an annular cross-section extending along its length that defines an axially extending aperture.

FIG. 3 shows a cross-section of the current limiter along line A-A' of FIG. 2.

In FIG. 3, the first and second electrically conductive wires 12,14 are respectively wound around the first and second formers to define first and second primary coils 18,20 respectively. The formers being of cylindrical shape means that each primary coil 18,20 defines a solenoid and thereby provides a uniform and controlled magnetic field.

The annular portion of the cryostat housing further includes an annular receptacle formed between the inner and outer surfaces of the annular portion to define a tank having outer and inner walls, whereby the outer wall is located between the annular receptacle and the outer surface of the annular portion, and the inner wall is located between the annular receptacle and the inner surface of the annular portion.

The electrically superconductive element 16 is shaped in the form of a tube, i.e. a one-turn coil, to define a secondary coil 22, and is located inside the tank formed within the annular portion of the cryostat housing. The secondary coil 22 is positioned within the tank so as to be spaced from the inner and outer walls of the tank.

In other embodiments, it is envisaged that the electrically superconductive element 16 may be replaced by a plurality of electrically superconductive elements, each electrically superconductive element being shaped in the form of a tube to define a secondary coil, the secondary coils being arranged to define a plurality of parallel-connected concentric tubes, i.e. a plurality of one-turn parallel-connected coils.

In use, the tank is filled with a coolant, such as liquid nitrogen, such that the coolant encloses the secondary coil 22. The purpose of the coolant is to cool the secondary coil 22, particularly after the secondary coil 22 enters the quench state. The tank is therefore sized to ensure that the required amount of coolant will be available in the tank.

The cryostat housing is located inside the correspondingly sized axially extending aperture of the first cylindrical former, while the second cylindrical former and the second primary coil 20 wound around the second cylindrical former are located inside the correspondingly sized axially extending aperture of the cryostat housing, As such, the first primary coil 18 is wound around the secondary coil 22 while the secondary coil 22 is wound around the second primary coil 20. The formers and the cryostat housing are aligned so that the overlap between the surface areas of the primary and secondary coils 18,20,22 is maximised to improve magnetic coupling between the primary and secondary coils 18,20,22.

In this arrangement, the annular space between the first primary coil 18 and the secondary coil 22 is equal to the sum of the radial gap between the secondary coil 22 and the outer wall of the tank, and the annular thicknesses of the first cylindrical former and the outer wall of the tank, while the annular space between the second primary coil 20 and the secondary coil 22 is equal to the sum of the radial gap between the secondary coil 22 and the inner wall of the tank, the wire diameter of the second primary coil 20 and the annular thickness of the inner wall of the tank.

The current limiter 10 further includes an iron core element 24 being sized to fit inside the axially extending aperture of the second cylindrical former, as shown in FIGS. 1 to 3. It is envisaged that, in other embodiments, the iron core element may be replaced by a core element including a different magnetic material, or an air-core element.

The inclusion of the iron core element 24 increases the strength of the magnetic field by concentrating the generated magnetic field lines within the iron core 24.

The ends of each primary coil 18,20 define a pair of terminals 26. The terminals 26 of the primary coils 18,20 are interconnected to define a pair of parallel-connected primary coils.

In use, the parallel-connected primary coils 18,20 are connected in series with an external electrical circuit that requires protection from excessive fault current.

During normal operation of the external electrical circuit, the secondary coil 22 is in a superconducting state and thereby exhibits a virtually zero resistance. The superconducting secondary coil 22 becomes a magnetic screen that minimises the amount of magnetic flux produced by the primary coils 18,20 that enters the iron core element 24. This in turn results in the parallel-connected primary coils 18,20 presenting a low impedance to the external electrical circuit, the low impedance having minimal influence on the normal current flowing through the external electrical circuit.

In the event of a fault leading to high fault current in the external electrical circuit, the increase in current in the external electrical circuit causes an increase in induced current in the secondary coil 22. When the induced current exceeds the critical current of the superconducting material, the secondary coil 22 enters a quench state whereby it exhibits a normal resistive state. Therefore, the magnetic shielding effect virtually disappears, which means that flux from the primary coils 18,20 is allowed to enter the iron core element 24. This results in the primary coils 18,20 presenting a large impedance to the external electrical circuit and thereby limiting the maximum value of the fault current flowing in the external electrical circuit.

The annular space between each primary coil 18,20 and the secondary coil 22 causes imperfect magnetic coupling of the primary and secondary coils 18,20,22, and thereby leads to the formation of leakage flux between the primary and secondary coils 18,20,22. The presence of leakage flux results in the primary coils 18,20 presenting a leakage reactance to the external electrical circuit. During normal operation of the external electrical circuit, a portion of the voltage supplied to the external electrical circuit appears across the leakage reactance.

The provision of the parallel-connected primary coils 18,20 in the current limiter 10 divides the amount of current flowing in each primary coil 18,20 and thereby reduces the amount of leakage flux between the primary and secondary coils 18,20,22 during normal operation of the external electrical circuit, when compared to a conventional current limiter having a single primary coil coupled to the superconducting secondary coil. This means that the effective leakage reactance presented by the parallel-connected primary coils 18,20 in a current limiter 10 according to the invention is lower than the effective leakage reactance presented by the single primary coil in a conventional current limiter.

The relative reduction in effective leakage reactance therefore improves the efficiency of the external electrical circuit connected to the current limiter 10 according to the invention over the same circuit connected to a conventional current limiter, since a lower percentage of the voltage supplied to the external electrical circuit is lost to the effective leakage reactance presented by the parallel-connected primary coils 18,20.

Employing parallel-connected primary coils 18,20 in the current limiter 10 to reduce leakage flux is also advantageous in that it does not require significant modification of the rest of the current limiter's structure, which would otherwise adversely affect the performance of the current limiter 10.

For example, one option for minimising leakage flux in the current limiter 10 is by reducing the annular space between the primary and secondary coils 18,20,22. This however requires modification of the cryostat housing to accommodate the reduction in annular space, and such modification leads to the reduction in radial dimensions of the cryostat housing, which in turn decreases the amount of coolant that is storable in the tank of the cryostat housing and thereby increases the risk of inadequate cooling of the superconductive secondary coil 22.

In addition, the reduction in leakage flux between the primary and secondary coils 18,20,22 reduces the magnetic forces acting on the superconducting secondary coil 22, which minimises the risk of the superconducting secondary coil 22 accidentally entering a quench state.

The reduction in current flowing through each primary coil 18,20 is also advantageous in that it improves surface cooling efficiency of the current limiter 10, since the amount of heat generated by each primary coil 18,20 is proportional to the square value of the current flowing through the respective primary coil 18,20.

In other embodiments, it is envisaged that the current limiter may be configured in different ways to define parallel-connected primary coils that encompass a superconducting secondary coil and are magnetically coupled to the superconducting secondary coil.

The invention claimed is:

1. A current limiter comprising a plurality of electrically conductive wires shaped to define two or more parallel-connected primary coils, the primary coils fitted to be connected in series with at least one external electrical circuit that requires protection from excessive fault current; and at least one electrically superconductive element shaped to define at least one secondary coil, wherein the primary coils are magnetically coupled to the at least one secondary coil, wherein first and second electrically conductive wires are respectively wound around first and second formers to define the first and second primary coils respectively, wherein each first primary coil is wound around a secondary coil while the secondary coil is wound around a second primary coil, wherein a core element is sized to fit inside the aperture of a second cylindrical former, and wherein each electrically superconductive element is located within the annular portion of a cryostat housing, so that when the current induced in said electrically superconductive element exceeds a critical current this electrically superconductive element, which normally exhibits a virtually zero resistance, enters a quench state whereby it exhibits a normal resistive state.

2. A current limiter according to claim 1 wherein the core element is a magnetic-core element or an air-core element.

3. A current limiter according to claim 2 wherein the cross-section of the magnetic core element is circular, oval or polyhedral in shape.

4. A current limiter according to claim 1 wherein each primary coil is in the form of a solenoid.

5. A current limiter according to claim 1 wherein the or each secondary coil is in the form of a tubular element.

6. A current limiter according to claim 5 wherein the current limiter includes a plurality of secondary coils in the form of tubular elements, the secondary coils being arranged to define a plurality of parallel-connected concentric tubes.

7. A current limiter according to claim 1 wherein the plurality of primary coils is operably connected, in use, to one or more electrical circuits.

8. A current limiter according to claim 7 wherein the plurality of primary coils present an impedance to minimise a fault current created by a fault, in use, in an electrical circuit.

9. A current limiter according to claim 1, wherein the secondary coil is short-circuited to form a closed current loop.

10. A current limiter comprising a core element, at least one first electrically conductive wire in a non-superconducting state, at least one second electrically conductive wire in a non-superconducting state, and a cryostat housing wherein at least one secondary coil made from an electrically superconductive material is arranged, the at least one second electrically conductive wire being wound around a portion of the core element to define at least one second primary coil, the cryostat housing being arranged so that the at least one second primary coil is nested within the at least one secondary coil, the at least one first electrically conductive wire being wound around the cryostat housing to define at least one first primary coil, wherein the at least one first primary coil and the at least one second primary coil are electrically connected in parallel, wherein the at least one first primary coil and the at least one second primary coil are fitted to be connected in series with at least one external electrical circuit that requires protection from excessive fault current, wherein the at least one secondary coil is magnetically coupled to the at least one first primary coil and to the at least one second primary coil, wherein the at least one first primary coil and the at least one second primary coil are able to produce an amount of magnetic flux in the at least one secondary coil, the amount of magnetic flux in the at least one secondary coil generating an induced current in the at least one secondary coil, wherein, when the induced current is lower than a critical current of the at least one secondary coil, the at least one secondary coil is configured to behave as a magnetic screen minimizing the amount of magnetic flux to reduce the impedance of the at least one first primary coil and the at least one second primary coil; and wherein, when the induced current exceeds the critical current of the secondary coil, the at least one secondary coil is configured to enter a quench state in which the at least one secondary coil does not behave as a magnetic screen.

11. A current limiter according to claim 10, wherein the secondary coil is short-circuited to form a closed current loop.

* * * * *